United States Patent [19]

Davids

[11] Patent Number: 4,517,558

[45] Date of Patent: May 14, 1985

[54] THREE DIMENSIONAL VIDEO SCREEN DISPLAY EFFECT

[75] Inventor: Robert E. Davids, Reno, Nev.

[73] Assignee: International Game Technology, Reno, Nev.

[21] Appl. No.: 374,016

[22] Filed: May 3, 1982

[51] Int. Cl.[3] ..... G07F 17/34; G09G 1/00

[52] U.S. Cl. ..... 340/700; 350/144; 273/143 R

[58] Field of Search ..... 340/700; 350/144, 314; 273/138 A, 141, 143 R

[56] References Cited

U.S. PATENT DOCUMENTS

| | | | |
|---|---|---|---|
| 1,696,359 | 12/1928 | Nelson | 273/143 R |
| 1,978,395 | 10/1934 | Groetchen | 273/143 R |
| 2,525,893 | 10/1950 | Gloess | 340/722 X |
| 3,701,581 | 10/1972 | Henkes, Jr. | 350/144 |
| 3,759,525 | 9/1973 | Davis | 273/143 R |
| 4,002,335 | 1/1977 | Bailey | 273/143 R X |

FOREIGN PATENT DOCUMENTS

| | | | |
|---|---|---|---|
| 49147 | 4/1977 | Japan | 273/138 A |
| 8200537 | 7/1980 | United Kingdom | 273/138 A |
| 2083936 | 3/1982 | United Kingdom | 273/138 A |

*Primary Examiner*—Marshall M. Curtis
*Assistant Examiner*—Vincent P. Kovalick
*Attorney, Agent, or Firm*—Seiler, Quirk & Tratos

[57] ABSTRACT

A three dimensional visual effect of rotating mechanical reels is given to a two dimensional display on a video screen by using a film having a continuous tone gradient from dark to light, the darkest portions extending along the upper and lower edges of the film, respectively, with the lightest adjacent the center of the film. The film is placed over the video screen images so that the darkened tone gradients of the film are over the upper and lower portion of the display, and the lighter portion of the film at the center is over the center of the display.

7 Claims, 2 Drawing Figures

THREE DIMENSIONAL VIDEO SCREEN DISPLAY EFFECT

BACKGROUND OF THE INVENTION

Mechanical coin-operated gaming devices, popularly known as slot machines, have incorporated rotatable drums or circular reels having thereon a plurality of indicia or designs, often in the form of a tape having the designs printed on it and secured to the surface of the reels. The reels are rotated by pulling a handle, and certain combinations of the designs which become aligned horizontally in a viewing window, indicate winning or losing combinations. Such an apparatus is shown, for example, in U.S. Pat. No. 3,285,380. More recently, the mechanical machines are becoming replaced by electronically operated machines using a video monitor having a video screen on which the indicia or designs are displayed. Such designs are in the form of two dimensional images displayed on the video screen in response to random or programmed signals in the electronic device. Although these newer electronic machines are superior to the older mechnical devices, requiring substantially less maintenance, since there is little mechanical breakdown, customers or users of the apparatus often find the mechanical devices more appealing and desirable to operate.

SUMMARY OF THE INVENTION

In the apparatus of the present invention, a three dimensional effect is given to two dimensional images shown on a video screen utilizing a continuous tone gradient film which has upper and lower darkened portions, and a center substantially clear or transparent portion. The film, when placed over the video screen, and combined with a mask or frame having a plurality of ports separating and highlighting the image segments, gives the visual illusion or effect of three dimensional reels, as viewed by the operator.

DETAILED DESCRIPTION OF THE INVENTION

Figure 1:
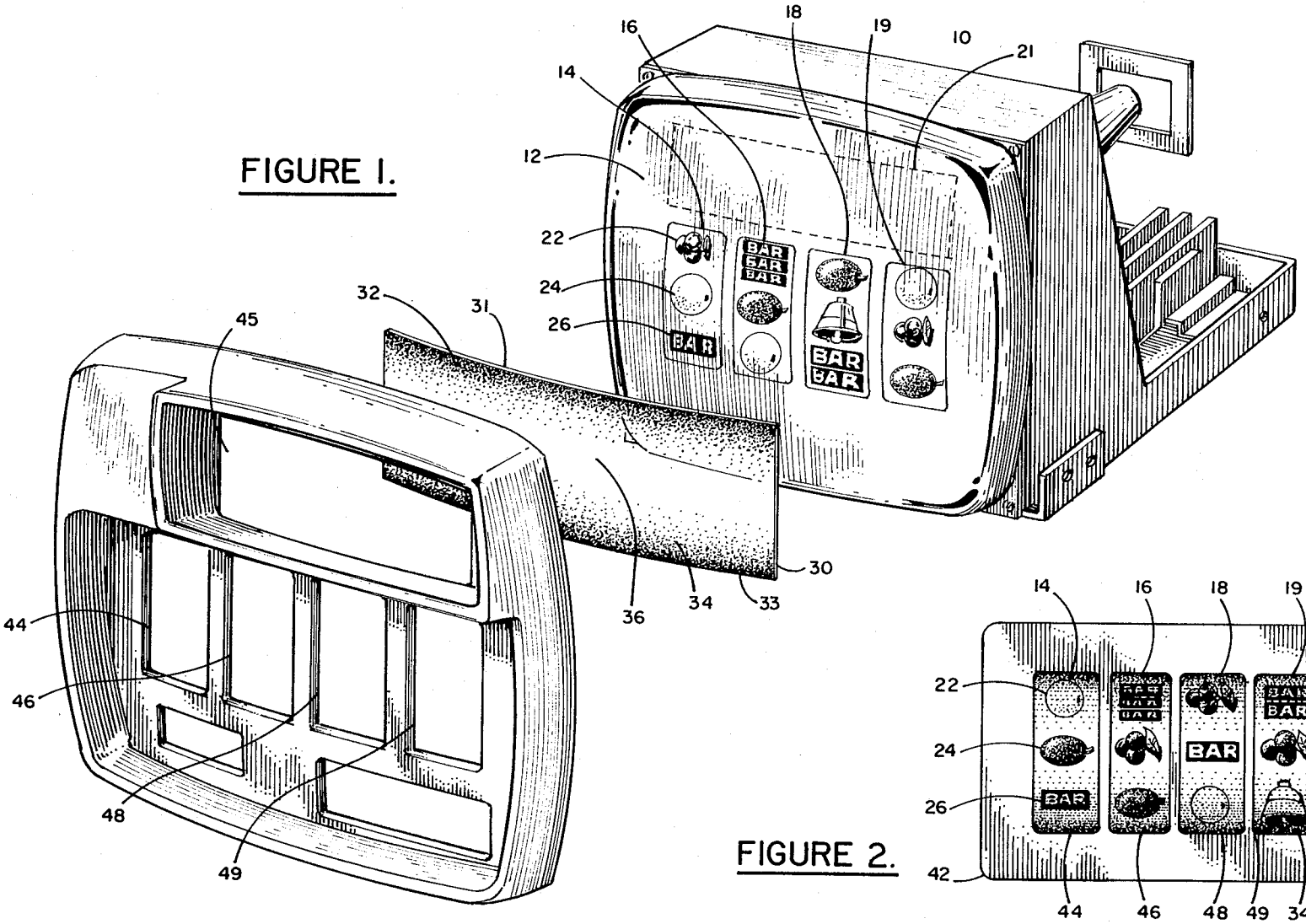
FIG. 1 is a perspective view showing the video display apparatus of the invention including the video monitor and screen, the film and mask or frame components.

In FIG. 1 there is shown the components of the improved apparatus of the invention comprising the video monitor 10 and video screen 12. On the screen are a plurality of display segments 14, 16, 18, and 19 which are projected on the screen by electronic video components of the apparatus and monitor, well known to those skilled in the art. In each of the display segments there is an upper image 22, a middle image 24, and lower image 26. These images are indicia or designs commonly associated with gaming machines as previously described, common designs including fruit such as cherries, oranges, lemons, as well as bells and other designs. Such designs are a matter of choice.

Although four display segments are shown, more or less may be used, depending on the type of machine and the type of game or display to be shown. Although three images in each display segment are shown, the number may be more or less, again depending on the type of game and display desired. Commonly, in such gaming devices, three, four or five display segments will be used to represent or resemble that same number of reels. As for the number of images in each display segment, although one or more of such images will be used, three are most popular since different payoffs may be achieved by aligning different combinations on the upper, middle, and lower lines, respectively. Again, such features are well known to those skilled in the art, and are optional with the invention. However, each of the display segments which are shown on video screen 12 are projected thereon in two dimensions since the screen is a two dimensional screen.

In order to give the illusion or appearance of three dimensional images, with each display segment representing a different rotating or rotatable reel as in previously described mechanical prior art devices, a continuous tone gradient film 30 is secured over the video screen. The film may be any suitable film material, preferably flexible so that when secured to the screen it follows the general contour of the screen surface. The most important feature of the film is that it has a continuous tone gradient from light to dark, with darkest tones being adjacent the upper and lower edges of the film and gradually becoming lighter toward the center of the film. In other words, a suitable film will comprise a film strip having an upper and lower horizontal edge 31 and 33 with upper and lower tone gradients 32 and 34, respectively, each of the gradients being darkest at the upper and lower edges, respectively, of the film strip and gradually getting lighter toward the center, preferably leaving a center strip 36 on the film which is substantially clear or transparent. It is preferred that the center strip be clear or transparent, although it is to be appreciated that absolute clarity is not possible. Thus, a very acceptable center strip will comprise an unshaded or unexposed portion of film referred to as "substantially" clear or transparent. Such a strip may even have a light tone according to the invention, but the lighter or clearer it is, the closer will that portion of the underlying reel image appear. The film may be continuous tone film, or it may be obtained by a graduated half-tone dot method. Other alternatives such as smoked glass or plastic may also be used, all intended to be within the purview of the invention and within the meaning of "film" herein.

The color or shade of the gradient tone is somewhat optional, but preferably is a grey or smoke shade which gives a natural shadow appearance as the film is viewed. The depth or darkness of the color, shade or tone may be varied to suit, but is preferably substantially or almost opaque at the upper and lower edges of the film. As such, it will almost mask the upper and lower edge areas of the display, making it appear to be further away from the observer than it actually is. The continuous tone gradient is preferably uniform in shading from darkest to clear, but any tone gradient is suitable, although that giving the most natural appearance of a circular reel to the image is most preferred.

Figure 2:
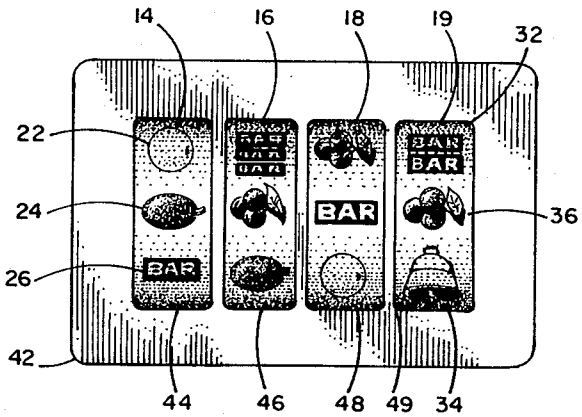
FIG. 2 is a front view of the display of the invention illustrating the three dimensional visual effect.

When the film strip is placed over the display segments on the video screen, as one observes the uppermost and lowermost portions of each display segment, because they are darker they appear to be further away from the observer than the center portion of the display segment which appears lighter. This feature is illustrated in FIG. 2 with the upper and lower portions of the segments gradually becoming darker as the distance increases from the center portion of each display segment. Accordingly, with the continuous tone gradient film properly secured on the video screen with the clear or transparent center strip 36 of the film overlying the center portion of each display segment, as the upper and lower portions of each display segment appear gradually darker from the center toward the upper and lower edges of each display segment, a three dimensional appearance representing a circular mechanical reel which gradually slopes away from an observer from the center of the reel displayed will be imagined. The specific size of the film strip is important in that it must sufficiently cover the display segments. Further, the upper and lower tone gradients must be such that there is substantial darkening at the upper and lower edges of the observed portion of the display segments, and with the height of the substantially clear or transparent center strip portion 36 of the film being sufficient to fully observe the center portion of the display segments, but not so great as to detract from the three dimensional effect. Accordingly, the film is preferably of a dimension whereby the upper and lower edges of the strip extend slightly beyond the respective upper and lower edges of the display segments which they cover, and with the upper and lower tone gradient portions of the strip each extending equally over about 20–40% of the film strip, with the clear center portion being between about 20 and about 40%. Preferably, each of the tone gradient portions will be approximately one-third and the clear center portion also about one-third of the area of the film strip, it being understood that each of these portions extend horizontally across the strip between the side edges thereof.

Yet another important component of the invention is a mask or frame 42 which includes one or more openings or viewing ports. The mask is also secured over the video screen such that the viewing port or ports are properly aligned with the display segments so that the latter can be viewed through the viewing port. Preferably, the number of viewing ports is the same as the number of display segments, so that the viewing ports frame the respective display segments. This is illustrated in FIGS. 1 and 2, with mask 42 having four viewing ports 44, 46, 48 and 49 through which the display segments 14. 16, 18, and 19 may be viewed or observed respectively. The frame preferably is sculptured or shaped to provide ports 44 which are inset or depressed from a raised frame surface or border, as shown. Thus, the frame itself preferably has three dimensional relief so that it creates highlights and shadows to further enhance the three dimensional effect of the screen. The frame may also optionally include one or more additional ports 45 for viewing other displays projected on the video screen, such as information regarding play of the game, winning combinations, etc., which do not form a part of this invention. These as well as other modifications of the apparatus within the purview of the invention will be evident to those skilled in the art.

I claim:

1. A video display apparatus comprising:

(a) a view screen showing a display of a plurality of horizontally aligned two dimensional display segments, (b) a mask secured in front of said screen having one or more viewing ports formed thereon for framing said display, and (c) a film secured to the front surface of said screen and covering the entire area of said viewing port said film having only two darkened areas, one extending horizontally across the top and the other horizontally across the bottom of said film, said darkened areas having a continuous tone gradient from darkest along the upper and lower edges of said film to lightest adjacent the center of said film to provide an unshaded horizontal substantially optically clear strip extending across the center of said film, said film being positioned relative to said viewing port so that said substantially clear strip is only along the approximate center thereof, whereby a three dimensional visual effect is given to said two dimensional display segments viewed through said film.

2. The video display apparatus of claim 1 wherein said mask comprises a plurality of viewing ports each one for viewing a different one of said display segments.

3. The video display apparatus of claim 2 wherein said two dimensional display segments comprise a plurality of vertically aligned upper, middle and lower images, said middle images visible through said clear strip of said film and said upper and lower images through upper and lower darkened areas of said film, respectively.

4. The apparatus of claims 1, 2, or 3 wherein the darkest portion of said continuous tone gradient of said film is substantially opaque along upper and lower edges of said film and said clear strip is substantially transparent.

5. In a video display apparatus having a sereen displaying a plurality of two dimensional images, the improvement comprising a film secured on the surface of said screen having a first and a second continuous tone gradient from substantially opaque to substantially transparent, said first and second tone gradients being disposed only along upper and lower portions of said film respectively, and extending between top and bottom edges thereof, said tone gradients being darkest adjacent said top and bottom edges of said film and substantially transparent along a center portion extending between opposite side edges of said film.

6. The apparatus of claim 5 wherein said two dimensional images are horizontally aligned whereby the center of said images are located along said center portion of said strip.

7. A video display apparatus comprising:

a video screen displaying a plurality of horizontally aligned two dimensional images, a film secured on the front surface of said screen, said film having only an upper and lower continuous tone gradient from substantially opaque darkness along an upper and lower edge, respectively, of said film to substantially transparent along a center portion thereof, said center portion being substantially uniform between said edges of said film and located over the horizontal center of said images, and a mask secured in front of said screen and said film having one or more viewing ports framing said images.

* * * * *